US009580781B2

(12) United States Patent
Jamwal et al.

(10) Patent No.: US 9,580,781 B2
(45) Date of Patent: Feb. 28, 2017

(54) PROCESS FOR MAKING COLD-ROLLED DUAL PHASE STEEL SHEET

(71) Applicant: THYSSENKRUPP STEEL USA, LLC, Calvert, AL (US)

(72) Inventors: Ranbir Jamwal, Mobile, AL (US); Joseph Frimpong, Saraland, AL (US); Bertram Wilhelm Ehrhardt, Mobile, AL (US); Harald Van Bracht, Theodore, AL (US); Roger Dale Boggs, Columbus, MS (US); Stanley Wayne Bevans, S. W. Decatur, AL (US)

(73) Assignee: Thyssenkrupp Steel USA, LLC, Calvert, AL (US)

( * ) Notice: Subject to any disclaimer, the term of this patent is extended or adjusted under 35 U.S.C. 154(b) by 513 days.

(21) Appl. No.: 14/085,010

(22) Filed: Nov. 20, 2013

(65) Prior Publication Data

US 2014/0137993 A1 May 22, 2014

Related U.S. Application Data

(60) Provisional application No. 61/728,541, filed on Nov. 20, 2012.

(51) Int. Cl.
*C22C 38/44* (2006.01)
*C21D 8/02* (2006.01)
(Continued)

(52) U.S. Cl.
CPC ..... *C22C 38/58* (2013.01); *C21D 8/0263* (2013.01); *C21D 8/04* (2013.01); *C21D 9/48* (2013.01); *C22C 38/001* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/38* (2013.01); *C22C 38/44* (2013.01); *C22C 38/48* (2013.01); *C22C 38/50* (2013.01)

(58) Field of Classification Search
None
See application file for complete search history.

(56) References Cited

FOREIGN PATENT DOCUMENTS

EP 1160346 A1 12/2001
RU 2351661 C1 4/2009
(Continued)

OTHER PUBLICATIONS

Machine-English translation of Japanese patent publication No. 2001-335890, Hikita Kazuo , Dec. 4, 2001.*
(Continued)

*Primary Examiner* — Deborah Yee
(74) *Attorney, Agent, or Firm* — Dinsmore & Shohl LLP

(57) ABSTRACT

Dual-phase steels and a process for producing a family of dual-phase steels that have a low YS/TS ratio and tensile strength above 590 MPa. The process includes employing low annealing temperatures combined with specific cooling strategies using gas jet rapid cooling equipped with "Ultra Rapid Cooling" (URC) capacity in the cooling tower. The process can also include the production of dual-phase steels with tensile strengths of at least 690 MPa by processing steels with specific cooling strategies using the URC having a refined Mo content towards the higher end of the chemical composition range mentioned in the current stated invention.

11 Claims, 2 Drawing Sheets

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/48*** | (2006.01) |
| ***C22C 38/50*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |
| ***C21D 8/04*** | (2006.01) |
| ***C21D 9/48*** | (2006.01) |

(56) References Cited

FOREIGN PATENT DOCUMENTS

| | | | |
|---|---|---|---|
| WO | 2004079022 | A1 | 9/2004 |
| WO | 2004104256 | A1 | 12/2004 |

OTHER PUBLICATIONS

Demeri, Mahmoudy (2010), "Chapter 4: Attributes of Advance High-Strength Steels", pp. 91-92, Advanced High Strength Steel, Scientific Technology & Application, ASM International.*

* cited by examiner

PROCESS FOR MAKING COLD-ROLLED DUAL PHASE STEEL SHEET

CROSS REFERENCE TO RELATED APPLICATIONS

This application claims priority to U.S. Provisional Patent Application Ser. No. 61/728,541 filed on Nov. 20, 2012, which is incorporated in its entirety herein by reference.

FIELD OF THE INVENTION

The present invention is related to a process for making a cold-rolled dual-phase steel sheet, and in particular to a process that uses an intercritical anneal and ultra rapid cooling to produce a cold-rolled dual-phase steel sheet having exceptional mechanical properties.

BACKGROUND OF THE INVENTION

Low-carbon steels having a yield strength of approximately 170 megapascals (MPa) that exhibit excellent deep drawing behavior are used in a variety of industries, e.g. the automobile industry. However, and despite their forming and cost advantages over high-strength steels, the relatively low-strength level of low-carbon steels results in crash performance of such materials being mainly dependent on a thickness of a sheet thereof. As such, first generation advanced high-strength steels (AHSS) have been developed in order to reduce the weight of automotive components and thereby afford improved vehicle fuel efficiency.

Among first generation AHSS, dual-phase steels are increasingly being used for vehicle components in order to reduce their weight. The excellent strength-ductility balance provide a large formability range and make them one of the most attractive choices for weight saving applications in automobiles.

Dual-phase steels can be produced by subjecting low-carbon steels to an intercritical anneal followed by sufficiently rapid cooling. It is appreciated that an intercritical anneal refers to annealing the steel at a temperature or temperature range below the material's $Ac_3$ temperature and above the $Ac_1$ temperature, i.e. where the microstructure of the steel consists of ferrite and austenite. Also, the rapid cooling of the material transforms the austenite into martensite such that a predominantly dual-phase ferrite-martensite microstructure is produced.

The addition of alloying elements in a low-carbon steel can circumvent the requirement of high cooling rates on a production line in order to obtain martensite as a low transformation product in a ferritic matrix. However, the addition of such alloying elements naturally increases the cost of the steel. In particular, alloying elements such as manganese, chromium, molybdenum, and niobium can be used to reduce the rate of cooling required for the transformation of the austenite to martensite. Also, molybdenum is an effective alloying element that imparts quench hardenability, along with the added benefit of not being prone to selective oxidation during annealing when compared to chromium, manganese, silicon, etc. As such, the use of molybdenum does not hamper the surface characteristics of processed dual-phase steels and affords for improved coating thereof.

Three basic methods are known for the commercial production of dual-phase steels. First, an as-hot-rolled method produces a dual-phase microstructure during conventional hot rolling through the control of chemistry and processing conditions. Second, a continuous annealing approach typically takes coiled hot- or cold-rolled steel strip, uncoils and anneals the steel strip in an intercritical temperature range in order to produce a ferrite plus austenite microstructure/matrix. Thereafter, rapid cooling higher than a critical cooling rate for the steel chemistry is applied to the strip to produce the ferrite-martensite microstructure. Finally, a batch annealing approach simply anneals coils of hot- or cold-rolled material.

SUMMARY OF THE INVENTION

A process for producing a family of dual-phase steels that have a low YS/TS ratio and tensile strength above 590 MPa is provided. The process includes employing low annealing temperatures combined with specific cooling strategies using gas jet rapid cooling equipped with "Ultra Rapid Cooling" (URC) capacity in the cooling tower. Using the URC, the process can also include the production of dual-phase steels with tensile strengths of at least 690 MPa by processing steels with alloying contents especially Mo towards the higher end of the suggested ranges mentioned in the current stated art.

The process can include providing a steel slab with a chemical composition within the range, in weight percent, of 0.085-0.11 carbon (C), 1.40-2.0 manganese (Mn), silicon (Si) no less than 0.16 to 0.5 maximum (max), chromium (Cr) no less than 0.13 to 0.5 max, titanium (Ti) 0.016 max, 0.09-0.21 molybdenum (Mo), 0.06 max nickel (Ni), 0.003 max sulfur (S), 0.015 max phosphorus (P), 0.006 max nitrogen (N), and 0.02-0.05 aluminum (Al) with the balance iron (Fe) is subjected to the inventive process disclosed herein. In addition, and in some instances, the ratio of weight percent aluminum divided by 27 to weight percent nitrogen divided by 14 is less than 10 ([wt % Al/27]/[wt % N/14] <10).

The steel slab can have a thickness of approximately 255 millimeters (mm) which is soaked at temperatures between 1160-1280° C. The soaked steel slab is hot rolled to produce hot-rolled strip which is coiled at temperatures between 600-680° C. The coiled hot-rolled strip has a ferrite-pearlite microstructure for additional downstream processing.

The coiled hot-rolled strip is uncoiled and cold rolled, the cold rolling producing at least a 60% reduction in thickness of the strip. In addition, the cold-rolled sheet is subjected to an intercritical anneal at temperatures between 760-800° C., which is then followed by rapid gas jet cooling using the URC to a temperature less than 450° C. The ultra rapidly cooled sheet has a ferrite-martensite microstructure with less than 6 volume percent (vol %) bainite, a 0.2% yield strength of at least 330 MPa, a tensile strength of at least 590 MPa, a total elongation to failure of at least 18%, and a uniform elongation of at least 10%.

In some instances, the ultra rapidly cooled sheet has a 0.2% yield strength between 330-450 MPa, a tensile strength between 590-680 MPa, a total elongation between 21-27%, and a uniform elongation between 13-18%. In addition, the rapidly cooled sheet can have a work hardening exponent for plastic deformation of the material within 4-6% ($n_{4-6}$) of greater than 0.14, and in some instances greater than 0.16.

The material also lends itself to bake hardening, i.e. the ultra rapidly cooled sheet can be bake hardened and exhibit an increase in strength of at least 30 MPa.

The hot rolling of the steel slab can include a roughing treatment that produces a transfer bar, followed by hot rolling the transfer bar into hot-rolled strip using a finishing treatment. The finishing treatment can have an entry temperature between 1050-1120° C. and an exit temperature between 860-910° C. In addition, the hot-rolled strip can be subjected to a cooling rate between 15-35° C./sec before coiling the material within the temperature range of 600-680° C. Finally, the intercritical anneal of the cold-rolled sheet at temperatures between 760-800° C. can be for a time period between 70-90 seconds.

In some instances, the composition of the steel slab described above has a refined Mo content between 0.15-0.21. In such instances, a hot-rolled plus cold-rolled plus intercritically annealed and rapidly cooled sheet using the URC has a 0.2% yield strength of at least 400 MPa, a tensile strength of at least 690 MPa, a total elongation to failure of at least 18%, and a uniform elongation of at least 10%. Furthermore, the ultra rapidly cooled sheet with the refined Mo content can have a 0.2% yield strength between 400-490 MPa, a tensile strength between 690-780 MPa, a total elongation between 21-27%, and a uniform elongation between 13-18%. The work hardening exponent $n_{4-6}$ is greater than 0.12, and in some instances greater than 0.14. The material can also be bake hardened with such a bake hardened sheet having an increase in strength of at least 30 MPa.

The present invention also affords for a dual-phase steel in the form of a cold-rolled sheet that has a chemical composition within the range described above, the cold-rolled sheet having a microstructure and mechanical properties as described above. Also, the cold-rolled sheet can have a refined molybdenum content as described above with improved/higher mechanical properties as discussed above.

DETAILED DESCRIPTION OF THE INVENTION

Figure 1:
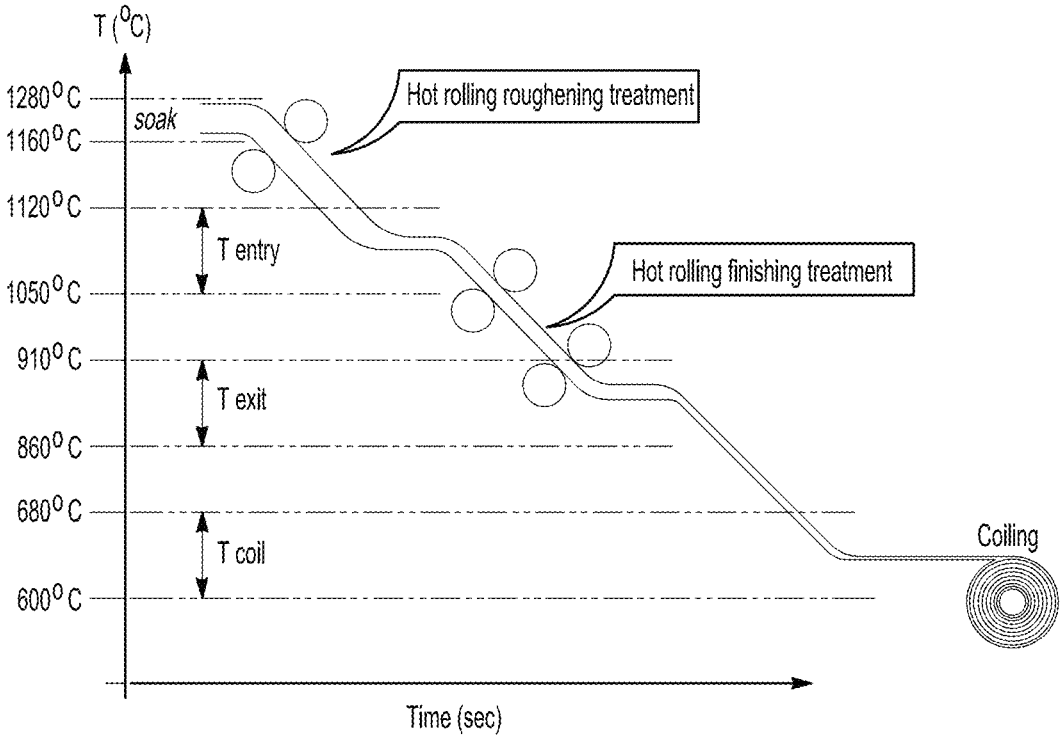
FIG. 1 is a graphical plot/illustration of temperature versus time for production of hot-rolled strip according to an embodiment of the present invention.

A process for producing a cold-rolled dual-phase steel having a microstructure of ferrite plus martensite, a low YS/TS ratio and a tensile strength of 590 MPa and above is provided. The process can be extended to obtain a higher strength family of dual-phase steels with tensile strengths of 690 MPa and above. As such, the invention has utility as a process for making steel sheet that can be used for manufacturing of parts, components, etc.

In some instances, the process includes producing cold-rolled low-carbon steel sheet and subjecting the steel sheet to an intercritical anneal within a continuous annealing line (CAL). Thereafter, the material is subjected to a rapid cooling treatment using the "Ultra Rapid Cooling" (URC) capacity in the cooling tower. For the purposes of the instant application, URC is defined as rapidly cooling with a maximum cooling rate capacity of 83 K/sec, for example by using adjustable plenum positions that afford for cooling fans to be moved closer to a passing steel strip in a cooling tower. In addition, the URC can have or include added cooling capacity available by hydrogen injection into the gas ranging from 0.1%-15%, with an optimum usage of 2-2.5% hydrogen. Also, it is appreciated that the URC "gas" can be air, nitrogen, air enriched with excess nitrogen, etc. In this manner, a 590 MPa dual-phase steel family or class of alloys is produced, the 590 MPa class of alloys having a 0.2% yield strength of at least 330 MPa, a tensile strength of at least 590 MPa, and a percent elongation of at least 21%.

In other instances, the inventive process provides a family of higher strength dual-phase steels (e.g. a 690 MPa class or family) with a more refined range of Mo, e.g. between 0.15-0.21. The 690 MPa class of alloys have a 0.2% yield strength of at least 400 MPa, a tensile strength of at least 690 MPa, and yet maintaining the percent elongation of at least 21% of the lower strength 590 MPa dual-phase class.

In addition to the above, both classes of steels can be press formed and subjected to a paint hardening treatment in order to be bake hardened (BH) as is known to those skilled in the art. The BH material can exhibit an increase in strength of at least 30 MPa.

In a preferred embodiment, a steel slab having a chemical alloy composition within the range of 0.085-0.11 weight percent carbon (C), 1.40-2.0 manganese (Mn), silicon (Si) no less than 0.16 to 0.5 maximum (max), chromium (Cr) no less than 0.13 to 0.5 max, titanium (Ti) 0.016 max, 0.09-0.21 molybdenum (Mo), 0.06 max nickel (Ni), 0.003 max sulfur (S), 0.015 max phosphorus (P), 0.006 max nitrogen (N), and 0.02-0.05 aluminum (Al) with the balance iron (Fe) and incidental melting impurities is subjected to the inventive process disclosed herein. In addition, and in some instances, the ratio of weight percent aluminum divided by 27 to weight percent nitrogen divided by 14 can be less than 10 ([wt % Al/27]/[wt % N/14]<10).

A slab of steel having a chemical composition within the above-stated range can be soaked at an elevated temperature, e.g. 1160-1280° C., to ensure that most if not all of the alloying elements are in solid solution. The slab is then subjected to a roughing treatment and/or a finishing treatment to produce a hot strip coil having a thickness between 2.3 and 5.3 millimeters (mm). The finishing treatment can have an entry temperature between 1050-1120° C. and an exit temperature between 860-910° C. In addition, the hot strip coil can be cooled after the finishing treatment at a cooling rate between 15-35° C./sec before being coiled at a temperature or within a temperature range of 600-680° C. to give a ferrite-pearlite starting structure for further downstream processing.

The hot strip coil is cold rolled with at least a 60% reduction in thickness of the strip, followed by intercritical annealing in a CAL. The intercritical annealing temperature is between 760-800° C. with an annealing time between 70-90 seconds. After subjecting the cold-rolled sheet to the intercritical annealing treatment, the sheet is rapidly cooled to a temperature less than 450° C. The cooling cycle involves using an "Ultra Rapid Cooling" section (URC) as defined earlier.

Cold-rolled steel sheet processed using the inventive process disclosed herein has a dual-phase ferrite-martensite microstructure with less than 6 volume percent (vol %) bainite present. In addition, the thickness of the cold-rolled sheet is a maximum of 2.3 mm and possesses good weldability. The 590 MPa dual-phase class steel sheet has a 0.2% yield strength between 330-450 MPa, a tensile strength between 590-680 MPa, a total percent elongation between 21-27%, and a uniform elongation between 13-18%. In addition, the steel sheet can have a work hardening exponent '$n_{4-6}$' above 0.17.

The higher strength class counterpart, i.e. the 690 MPa class of alloys, exhibits a 0.2% yield strength between 400-490 MPa, a tensile strength between 690-780 MPa, a total percent elongation between 21-27%, and a uniform elongation between 13-18%. Also, the material has a work hardening exponent '$n_{4-6}$' above 0.15. Finally, bake hardening of both classes of alloys, e.g. strain hardening plus subjecting the material to an elevated temperature of approximately 170° C. for 20 minutes, provides an increase in strength of at least 30 MPa.

Turning now to FIG. 1, a graphical illustration of a process to produce hot strip coil is shown. The process includes soaking a slab of steel having a composition within the range described above at temperatures between 1160-1280° C. The steel slab is subjected to a hot-rolling roughing treatment to produce a transfer bar which is then subjected to a hot-rolling finishing treatment. The hot-rolling finishing treatment has an entry temperature between 1050-1120° C. and an exit temperature between 860-910° C. The hot-rolling finishing treatment produces hot-rolled strip which is then coiled at temperatures between 600-680° C.

Figure 2:
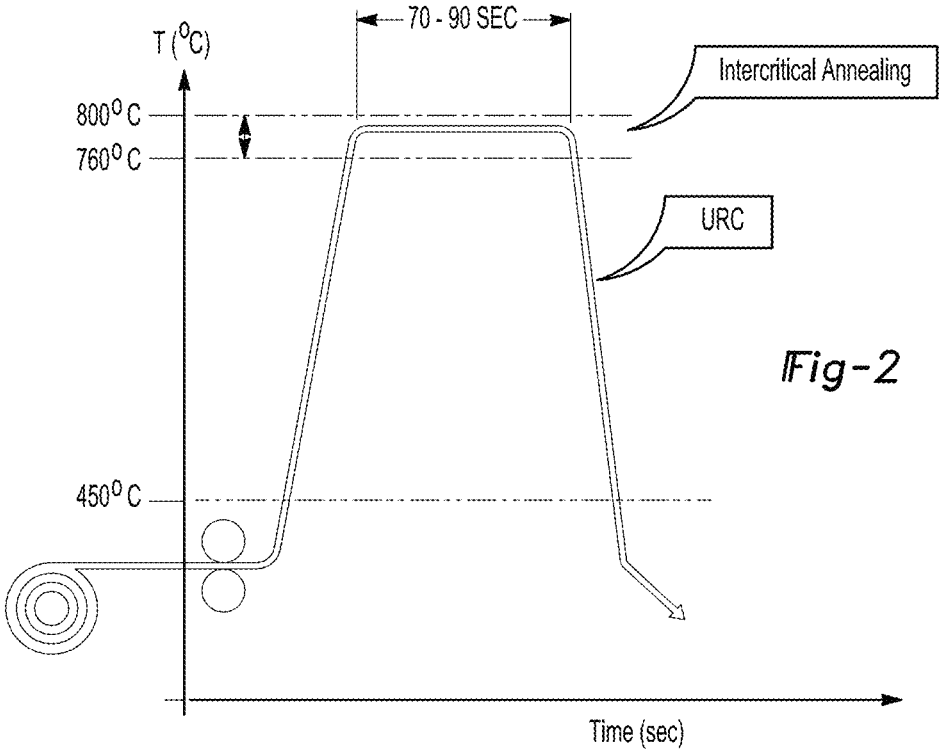
FIG. 2 is a graphical plot/illustration of a temperature-time profile for intercritical annealing and ultra rapid cooling to produce a cold-rolled dual-phase steel according to an embodiment of the present invention.

Referring to FIG. 2, the coil of hot-rolled strip is then subjected to cold rolling in which a reduction in thickness of the hot-rolled strip is at least 60%. It is appreciated that the reduction in thickness is calculated using the formula:

$$\frac{l_0 - l_f}{l_o} \times 100,$$

where $l_o$ is the original thickness of the hot rolled strip and $l_f$ is the final thickness of the cold rolled sheet. The cold-rolled material is subjected to intercritical annealing at temperatures between 760-800° C. and for a time period between 70-90 seconds. Thereafter, the intercritically annealed cold-rolled sheet is subjected to ultra rapid cooling.

The microstructure of the finished ultra rapidly cooled and cold-rolled sheet is dual phase with islands of martensite within a matrix of ferrite.

In order to provide a specific teaching of the invention and yet not limit the scope thereof in any way, examples of the process according to embodiments of the invention are provided below.

Example 1

Steel slabs with a thickness of approximately 255 mm and heat chemistries identified as Heat 1, Heat 2 and Heat 3 with a chemical composition in mass % as shown in Table 1 below were soaked at approximately 1220° C. Thereafter, the slabs were subjected to a roughing treatment to produce a transfer bar. The transfer bar was then subjected to a finishing treatment with an entry temperature of 1090° C. and an exit temperature of 880° C., and hot strip with a thickness between 2.3 and 5.3 mm was produced. The hot strip was then cooled at 20° C./sec to 660° C. and coiled.

TABLE 1

| | C | Mn | Si | P | S | Al | N | Cr | Ti | Mo | Nb | Ni |
|---|---|---|---|---|---|---|---|---|---|---|---|---|
| Heat 1 | 0.1 | 1.438 | 0.178 | 0.0109 | 0.0024 | 0.0338 | 0.0054 | 0.164 | 0.001 | 0.097 | 0.002 | 0.01 |
| Heat 2 | 0.106 | 1.399 | 0.179 | 0.0117 | 0.0017 | 0.0308 | 0.0035 | 0.163 | 0.0011 | 0.103 | 0.0025 | 0.011 |
| Heat 3 | 0.107 | 1.426 | 0.177 | 0.0117 | 0.0027 | 0.0339 | 0.0043 | 0.158 | 0.0011 | 0.103 | 0.0019 | 0.011 |
| Heat 4 | 0.106 | 1.501 | 0.179 | 0.0145 | 0.0022 | 0.041 | 0.0049 | 0.146 | 0.0019 | 0.201 | 0.002 | 0.016 |
| Heat 5 | 0.102 | 1.408 | 0.179 | 0.0153 | 0.0024 | 0.0331 | 0.0038 | 0.162 | 0.0023 | 0.197 | 0.002 | 0.014 |

Figure 3:
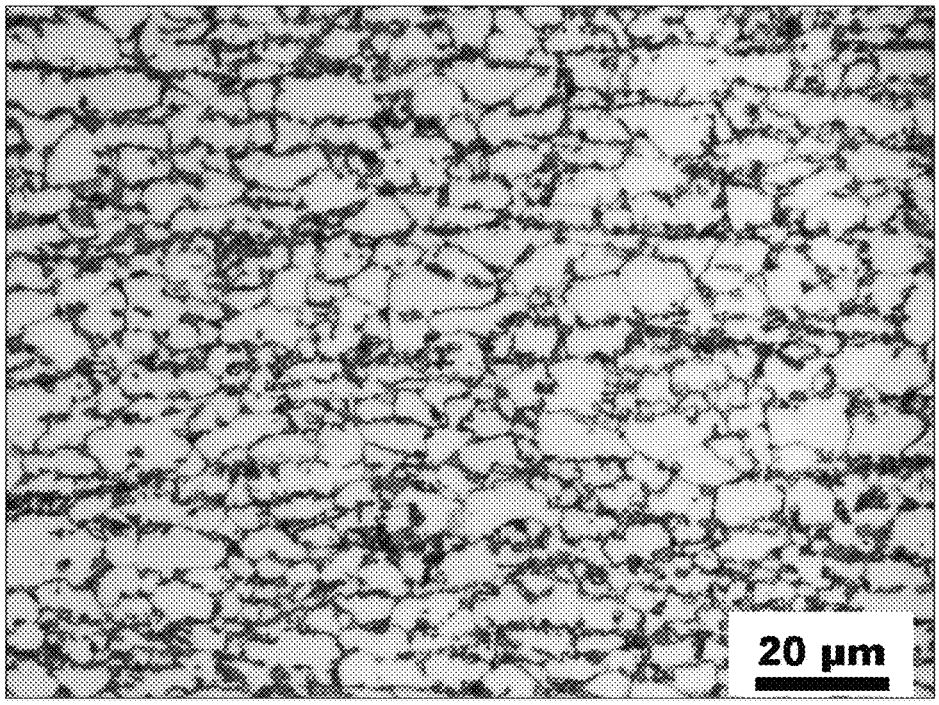
FIG. 3 is an optical micrograph of a nital etched microstructure for a cold-rolled dual-phase steel produced according to an embodiment of the present invention and belonging to a class of alloys having tensile strengths equal to or greater than 590 MPa.

The coiled hot strip was cold rolled to produce a 69% reduction in thickness, followed by intercritical annealing on a CAL at 770° C. for 80 seconds. Thereafter, the steel strip was gas jet cooled using URC to a temperature of less than 450° C. A representative microstructure of a cold-rolled dual-phase steel processed according to an embodiment of the present invention and having a grain size of ASTM 13, a percent volume fraction of martensite between 20-28% and less than 6 vol % bainite is shown in FIG. 3.

Test samples were taken from the cold-rolled steel sheet and subjected to standard mechanical testing. Results of the testing for samples taken from head and tail sections of the coils are shown in Table 2 below.

TABLE 2

| Annealing | 0.2% YS (MPa) | TS (MPa) | % E A50 | $n_{4-6}$ | YS/TS | BH2 (MPa) |
|---|---|---|---|---|---|---|
| | Avg. Head | | | | | |
| 760-780° C. | 375 | 638 | 25.7 | 0.23 | 0.58 | >30 |
| | Avg. Tail | | | | | |
| | 382 | 637 | 25.1 | 0.21 | 0.59 | |

Example 2

Steel slabs approximately 255 mm thick with heat chemistries 4 and 5 as defined in Table 1, were soaked at approximately 1230° C. The soaked slabs were hot rolled via a roughing treatment to produce a transfer bar. Thereafter, the transfer bar was subjected to a finishing treatment with an entry temperature of 1090° C. and an exit temperature of 880° C. and hot strip with a thickness between 2.3 and 5.3 mm was produced. The hot strip was then cooled at 20° C./sec to 660° C. and coiled.

Figure 4:
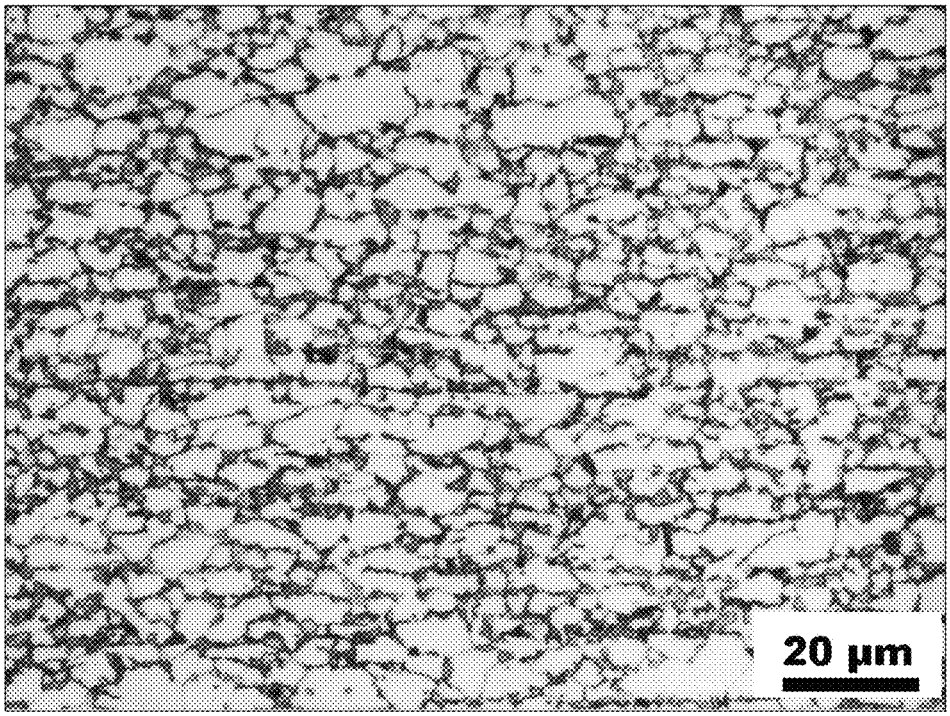
FIG. 4 is an optical micrograph of a nital etched microstructure for a cold-rolled dual-phase steel produced according to an embodiment of the present invention and belonging to a class of alloys having tensile strengths equal to or greater than 690 MPa.

The coiled hot strip was cold rolled to produce a 69% reduction in thickness, followed by intercritical annealing on a CAL at 780° C. for 80 seconds. Thereafter, the steel strip was gas jet cooled using URC to a temperature less than 450° C. The microstructure of the cold-rolled steel sheet had a grain size of ASTM 13, was dual phase with islands of martensite within a matrix of ferrite. FIG. 4 is an optical micrograph of the ferrite-martensite microstructure for such a steel, with a high percentage volume fraction of martensite (28-32%) being present.

Test samples taken from the cold-rolled steel sheet and subjected to standardized mechanical testing. Average values for coil head and tail samples are shown in Table 3 below. It is appreciated that the higher volume fraction of the martensite as compared to the volume fraction shown in FIG. 3 shifts the cold-rolled dual-phase product to the dual-phase steel grade family having a tensile strength of at least 690 MPa.

TABLE 3

| Annealing | 0.2% YS (MPa) | TS (MPa) | % E A50 | $N_{4\text{-}6\%}$ | YS/TS | BH2 (MPa) |
|---|---|---|---|---|---|---|
| | Avg. Head | | | | | |
| 760-800° C. | 431 | 733 | 23 | 0.19 | 0.58 | >30 |
| | Avg. Tail | | | | | |
| | 451 | 725 | 23 | 0.17 | 0.62 | |

As shown by the data, intercritical annealing as disclosed herein, in combination with specific rapid cooling strategies involving the use of the URC, afford a family of cold-rolled dual-phase steel sheet with exceptional mechanical properties.

In view of the teaching presented herein, it is to be understood that numerous modifications and variations of the present invention will be readily apparent to those of skill in the art. The foregoing is illustrative of specific embodiments of the invention, but is not meant to be a limitation upon the practice thereof. As such, the specification should be interpreted broadly.

We claim:

1. A process for producing a cold-rolled dual-phase steel, the process comprising:

providing a steel slab with a chemical composition within the range, in weight percent, of 0.085-0.11 C, 1.4-2.0 Mn, 0.09-0.21 Mo, 0.02-0.05 Al, 0.16-0.5 Si, 0.13-0.5 Cr, 0.016 max Ti, 0.06 max Ni, 0.003 max S, 0.015 max P, 0.006 max N, balance Fe and incidental melting impurities;

soaking the steel slab at temperatures between 1160-1280° C.;

hot rolling the steel slab into a transfer bar using a roughing treatment;

hot rolling the transfer bar into the hot-rolled strip using a finishing treatment, the finishing treatment having an entry temperature between 1050-1120° C. and an exit temperature between 860-910° C.; and cooling the hot-rolled strip at a cooling rate between 15-35° C/sec;

coiling the hot-rolled strip at temperatures between 600-680° C., the coiled hot-rolled strip having a ferrite-pearlite microstructure;

cold rolling the coiled hot-rolled strip into cold-rolled sheet, the cold-rolled sheet having at least a 60% reduction in thickness compared to a thickness of the coiled hot-rolled strip;

intercritical annealing the cold-rolled sheet at temperatures between 760-800° C.; and rapidly cooling the intercritically annealed cold-rolled sheet to a temperature less than 450° C. using "Ultra Rapid Cooling" using an air plus hydrogen gas mixture and adjustable plenum positions to move cooling fans closer to the intercritically annealed cold-rolled sheet during the Ultra Rapid Cooling;

the ultra rapidly cooled sheet having a ferrite-martensite microstructure with less than 6 vol% bainite, a 0.2% yield strength of at least 330 MPa, a tensile strength of at least 590 MPa, a total elongation to failure of at least 18% and a uniform elongation of at least 10%.

2. The process of claim 1, wherein the ultra rapidly cooled sheet has a yield strength between 330-450 MPa, a tensile strength between 590-680 MPa, a total elongation between 21-27% and a uniform elongation between 13-18%.

3. The process of claim 2, wherein the ultra rapidly cooled sheet has a work hardening exponent $n_{4\text{-}6}$ greater than 0.14.

4. The process of claim 3, wherein the work hardening exponent $n_{4\text{-}6}$ is greater than 0.16.

5. The process of claim 4, further including bake hardening the ultra rapidly cooled sheet, the bake hardened sheet having an increase in strength of at least 30 MPa.

6. The process of claim 1, wherein the ultra rapidly cooled sheet is intercritically annealed at temperatures between 760-800° C. for a time period between 70-90seconds.

7. The process of claim 1, wherein the Mo content of the steel slab is between 0.15-0.21 and the ultra rapidly cooled sheet has a 0.2% yield strength of at least 400 MPa, a tensile strength of at least 690 MPa, a total elongation to failure of at least 18% and a uniform elongation of at least 10%.

8. The process of claim 7, wherein the ultra rapidly cooled sheet has a yield strength between 400-490 MPa, a tensile strength between 690-780 MPa, a total elongation between 21-27% and a uniform elongation between 13-18%.

9. The process of claim 8, wherein the ultra rapidly cooled sheet has a work hardening exponent $n_{4\text{-}6}$ greater than 0.12.

10. The process of claim 9, wherein the work hardening exponent $n_{4\text{-}6}$ is greater than 0.14.

11. The process of claim 10, further including bake hardening the rapidly cooled sheet, the bake hardened sheet having an increase in strength of at least 30 MPa.

* * * * *